US010012427B2

(12) United States Patent
Cheon

(10) Patent No.: US 10,012,427 B2
(45) Date of Patent: Jul. 3, 2018

(54) REFRIGERATOR AND REFRIGERATOR MANUFACTURING METHOD

(71) Applicant: Dongbu Daewoo Electronics Corporation, Seoul (KR)

(72) Inventor: Woo Cheol Cheon, Seoul (KR)

(73) Assignee: Dongbu Daewoo Electronics Corporation, Seoul (KR)

( * ) Notice: Subject to any disclaimer, the term of this patent is extended or adjusted under 35 U.S.C. 154(b) by 0 days.

(21) Appl. No.: 15/365,845

(22) Filed: Nov. 30, 2016

(65) Prior Publication Data

US 2017/0343273 A1 Nov. 30, 2017

(30) Foreign Application Priority Data

May 31, 2016 (KR) ..... 10-2016-0067410

(51) Int. Cl.

| | |
|---|---|
| ***A47B 96/04*** | (2006.01) |
| ***F25D 23/02*** | (2006.01) |
| ***E06B 3/263*** | (2006.01) |
| ***F25D 11/00*** | (2006.01) |

(52) U.S. Cl.

CPC ..... *F25D 23/02* (2013.01); *E06B 3/263* (2013.01); *F25D 11/00* (2013.01); *F25D 2201/126* (2013.01)

(58) Field of Classification Search

CPC .... F25D 23/02; F25D 11/00; F25D 2201/126; E06B 3/263

See application file for complete search history.

(56) References Cited

U.S. PATENT DOCUMENTS

| | | | | |
|---|---|---|---|---|
| 2,839,347 | A * | 6/1958 | Strub | F25D 23/04 312/321.5 |
| 4,583,796 | A * | 4/1986 | Nakajima | F25D 23/02 312/296 |
| 9,470,450 | B2 * | 10/2016 | Do | F25D 23/028 |
| 2004/0194253 | A1 * | 10/2004 | Jung | F25D 23/02 16/87.2 |
| 2006/0265960 | A1 * | 11/2006 | Leimkuehler | F25D 23/02 49/501 |
| 2008/0042537 | A1 * | 2/2008 | Kim | F25D 23/02 312/405 |
| 2010/0156260 | A1 * | 6/2010 | Arzoz Barandalla | F25D 23/028 312/405 |
| 2010/0180627 | A1 * | 7/2010 | Hanke | F25D 23/02 62/449 |
| 2013/0026900 | A1 * | 1/2013 | Oh | F25D 23/02 312/401 |

(Continued)

FOREIGN PATENT DOCUMENTS

| | | |
|---|---|---|
| KR | 10-1998-0069674 A | 10/1998 |
| KR | 10-2001-0111427 A | 12/2001 |

*Primary Examiner* — Hanh V Tran

(57) ABSTRACT

A refrigerator is disclosed including a refrigerator compartment configured to store food, and a door configured to selectively open and close the refrigerator compartment. The door includes a first frame disposed on a front surface and side surfaces of the door, and second frames connected to a top and a bottom of the first frame, where the first frame and/or the second frames including fixing portions configured to fix the first frame to the second frames. A manufacturing method for efficiently manufacturing a refrigerator is also disclosed.

12 Claims, 8 Drawing Sheets

(56) References Cited

U.S. PATENT DOCUMENTS

2013/0099650 A1* 4/2013 Lee ..... F25D 23/028
312/404
2013/0293080 A1* 11/2013 Kim ..... F25D 23/02
312/404
2014/0132146 A1* 5/2014 Kim ..... F25D 23/025
312/405.1
2014/0300263 A1* 10/2014 Sung ..... G06F 3/044
312/404
2015/0145399 A1* 5/2015 Joo ..... F25D 23/02
312/404
2015/0219387 A1* 8/2015 Kim ..... F25D 23/028
312/404
2015/0241115 A1* 8/2015 Strauss ..... F25D 23/02
312/405
2016/0138852 A1* 5/2016 Do ..... F25D 23/028
312/405
2016/0341468 A1* 11/2016 Joo ..... F25D 11/02

* cited by examiner

REFRIGERATOR AND REFRIGERATOR MANUFACTURING METHOD

CROSS-REFERENCE TO RELATED APPLICATIONS

This application is based on and claims priority from Korean Patent Application No. 10-2016-0067410, filed on May 31, 2016, the disclosure of which is incorporated herein in its entirety by reference.

TECHNICAL FIELD

Embodiments of the present disclosure generally relate to the field of refrigeration, and more specifically, to a refrigerator and an efficient refrigerator manufacturing method.

BACKGROUND

A refrigerator is an apparatus for storing food at a low temperature and may be configured to store food in a refrigerated state or a frozen state. The interior of the refrigerator is generally divided into a refrigeration compartment and a freezing compartment. The refrigerator includes a heat exchanger configured to supply cold air into the refrigerator.

Cold air supplied into the refrigerator is generated by a heat exchange action of a refrigerant using a heat exchanger. In other words, the cold air is generated by repeating a cycle consisting of compression, condensation, expansion and evaporation in the heat exchanger before being supplied into the refrigerator. Cold air is uniformly transferred to the interior of the refrigerator by convection and is used to store food at a desired temperature within the refrigerator.

In general, the refrigerator includes a main body having a rectangular cuboid shape with an opening on a front surface thereof. A refrigeration compartment and a freezing compartment may be disposed within the main body. Drawers, racks, storage boxes and the like for storing different kinds of food in an optimal state may be provided in the internal storage spaces of the refrigerator. A refrigeration compartment door and a freezing compartment door for selectively opening and closing portions may be provided on the front surface of the main body.

The refrigeration compartment door and the freezing compartment door may be filled with a foaming body or material to thermally insulate the interior of the refrigerator from the outside. The filling of the foaming body is typically performed after a refrigerator panel and an isolation plate are assembled together.

When manufacturing the refrigerator doors using this method, the refrigerator panel or the isolation plate may be pushed or moved by the injection pressure of the foaming body when injecting the foaming body. In this case, the refrigerator panel and the isolation plate may be separated from each other, or the bond between the refrigerator panel and the isolation plate may be weakened or destroyed. Furthermore, the refrigerator panel and the isolation plate may be separated from each other during transportation or installation, for example.

In order to solve this problem, in recent years, a temporary assembly step is added when assembling the door panel and the isolation plates. For example, the isolation plates are temporarily fixed at an upper end and a lower end of the door panel using temporary fixing means, such as tape. A foaming body is injected into the door. When the foaming process is complete, the temporary fixing means (e.g., tape) are removed.

The process of temporarily assembling and disassembling the door panel and the isolation plate is onerous and inefficient. The increase in steps required to complete such a manufacturing method leads to an increase in the overall refrigerator manufacturing time, and a decrease in manufacturing efficiency.

SUMMARY

Embodiments of the present disclosure provide a refrigerator capable of eliminating a temporary assembly step when manufacturing a door of a refrigerator.

According to one embodiment of the present disclosure, a refrigerator is disclosed. The refrigerator includes a refrigerator compartment, and a door configured to selectively open and close the refrigerator compartment. The door includes a first frame disposed on a front surface and side surfaces of the door, and second frames connected to a top and a bottom of the first frame, where the first frame is affixed to the second frames.

According to another embodiment, a refrigerator manufacturing method is disclosed. The method includes bending a plate to form a first frame disposed on a front surface and side surfaces of a door, where the door selectively opens and closes a refrigerator compartment, connecting second frames to a top and a bottom of the first frame, affixing the first frame to the second frames, filling a foaming body into a space between the first frame and the second frames, disposing a third frame on a rear surface of the door, and affixing the third frame to at least one of the first frame and the second frames.

DETAILED DESCRIPTION

Figure 1:
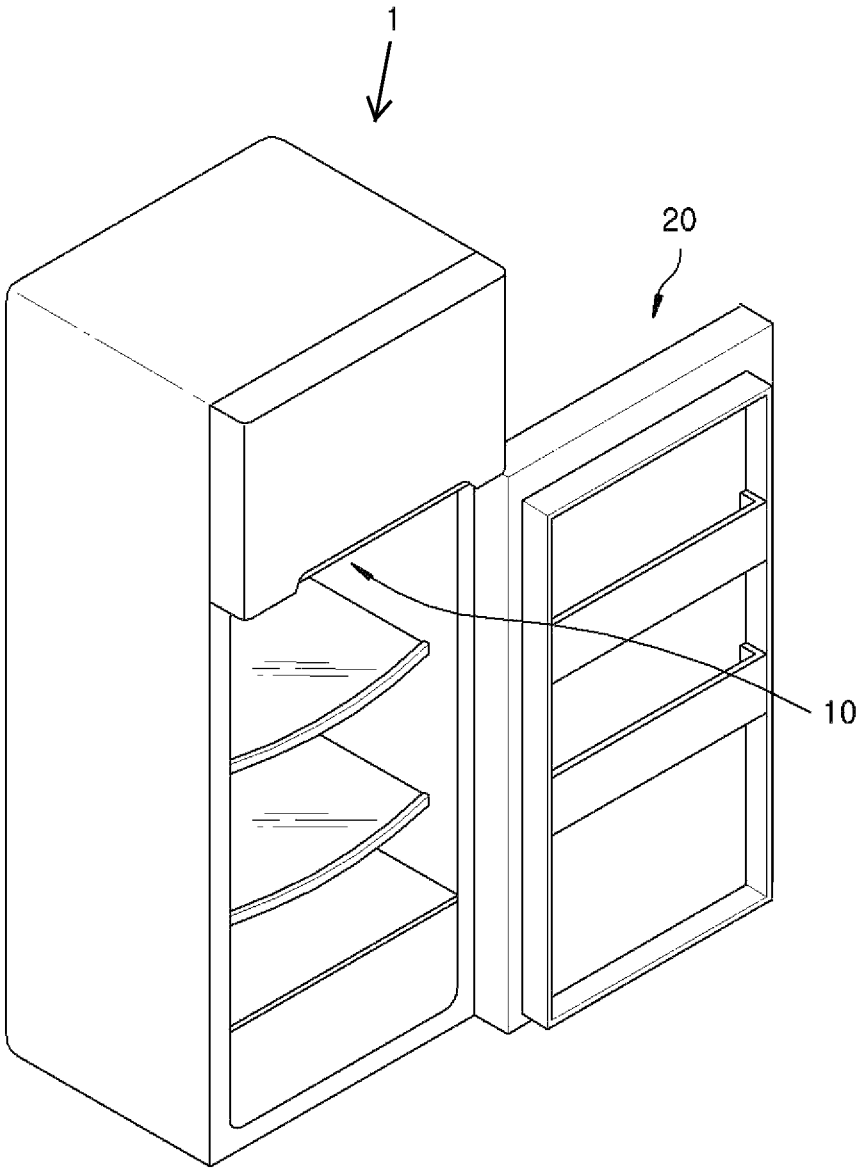
FIG. 1 is a perspective view illustrating an exemplary refrigerator including a heat dissipating blower according to one embodiment of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

One or more exemplary embodiments of the present disclosure will be described more fully hereinafter with reference to the accompanying drawings, in which one or more exemplary embodiments of the disclosure can be easily determined by those skilled in the art. As those skilled in the art will realize, the described exemplary embodiments may be modified in various different ways, all without departing from the spirit or scope of the present disclosure, which is not limited to the exemplary embodiments described herein.

It is noted that the drawings are schematic and are not necessarily dimensionally illustrated. Relative sizes and proportions of parts in the drawings may be exaggerated or reduced in their size, and a predetermined size is merely exemplary and not limiting. The same reference numerals designate the same structures, elements, or parts illustrated in two or more drawings in order to exhibit similar characteristics.

The exemplary drawings of the present disclosure illustrate ideal exemplary embodiments of the present disclosure in more detail. As a result, various modifications of the drawings are expected. Accordingly, the exemplary embodiments are not limited to a specific form of the illustrated region, and for example, include a modification of form due to manufacturing.

A refrigerator and a refrigerator manufacturing method according to embodiments of the present disclosure will now be described with reference to FIGS. 1 to 7.

Figure 2:
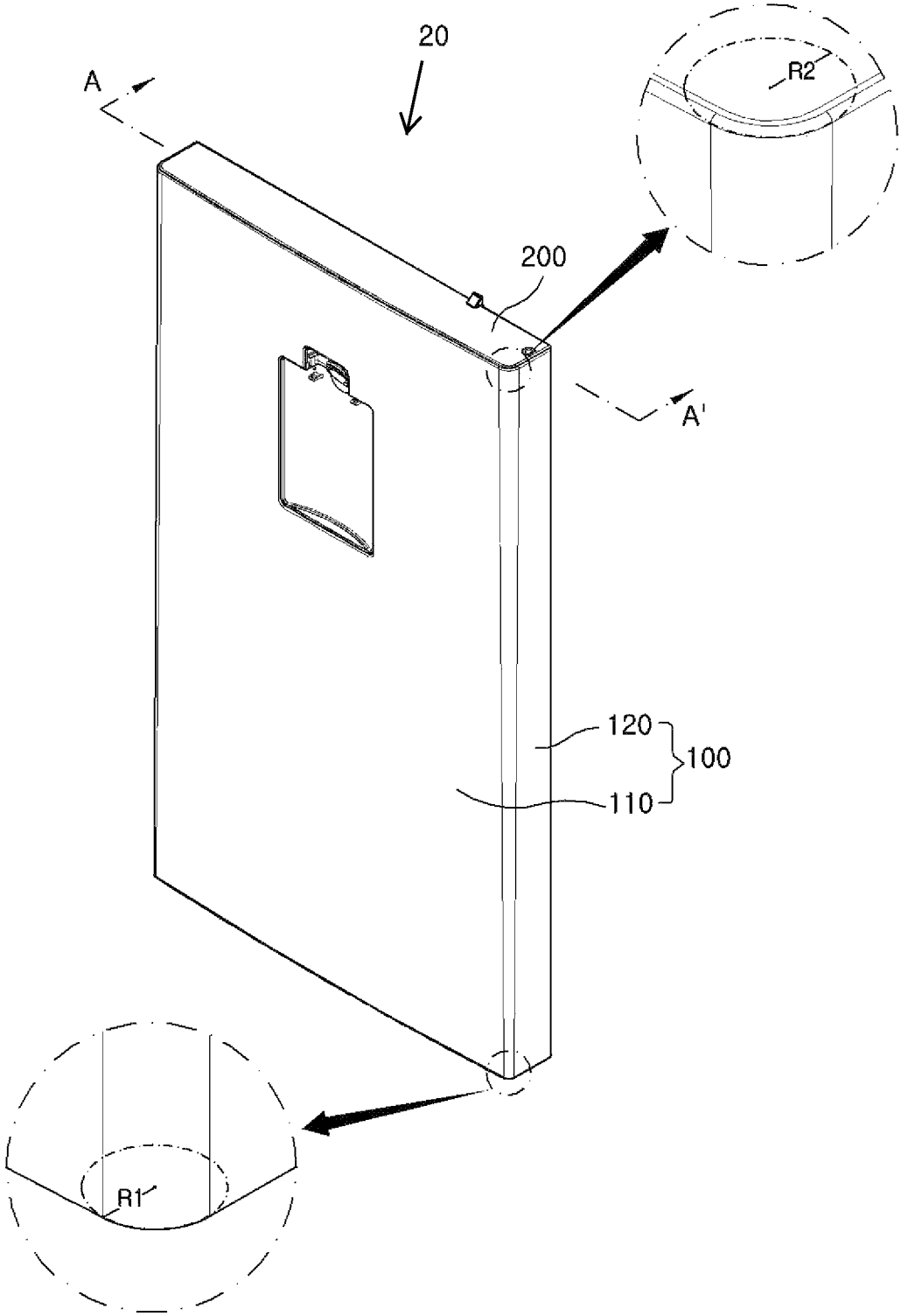
FIG. 2 is a perspective view of an exemplary door provided in the refrigerator illustrated in FIG. 1 according to one embodiment of the present disclosure.
Figure 3:
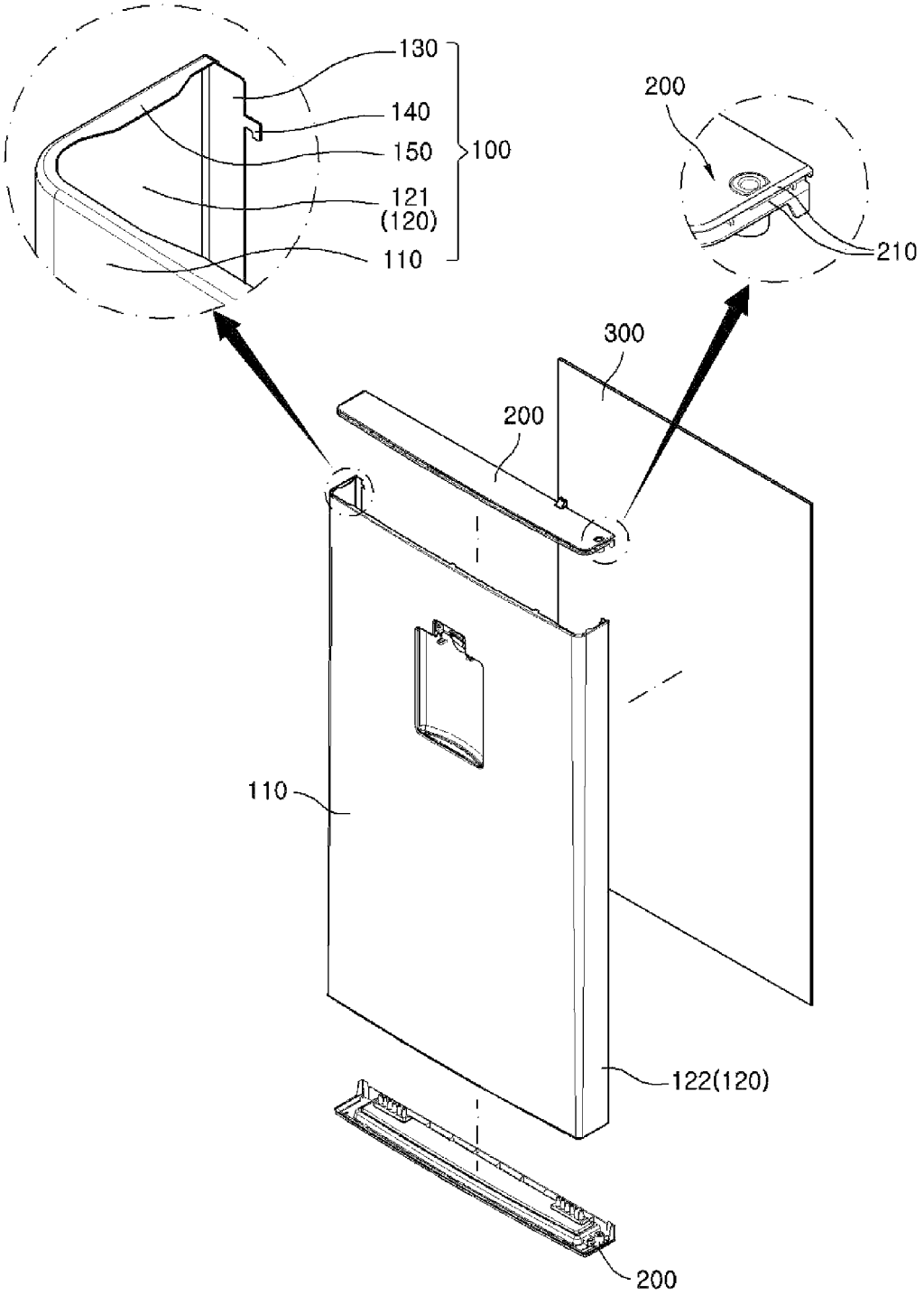
FIG. 3 is an exploded perspective view of the door illustrated in FIG. 2 according to one embodiment of the present disclosure.
Figure 4:
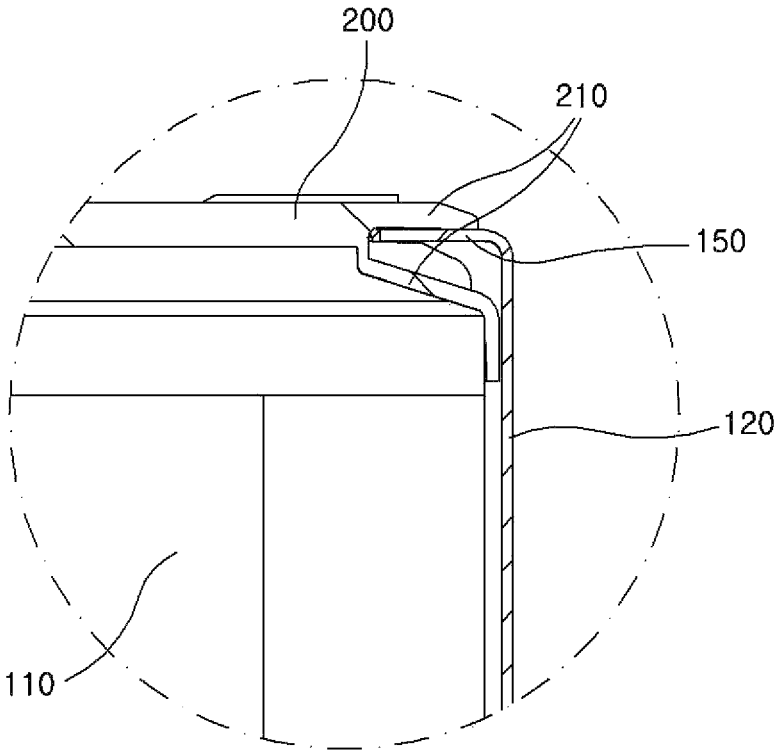
FIG. 4 is a sectional view of the door from the perspective of A-A' in FIG. 2 according to one embodiment of the present disclosure.
Figure 5:
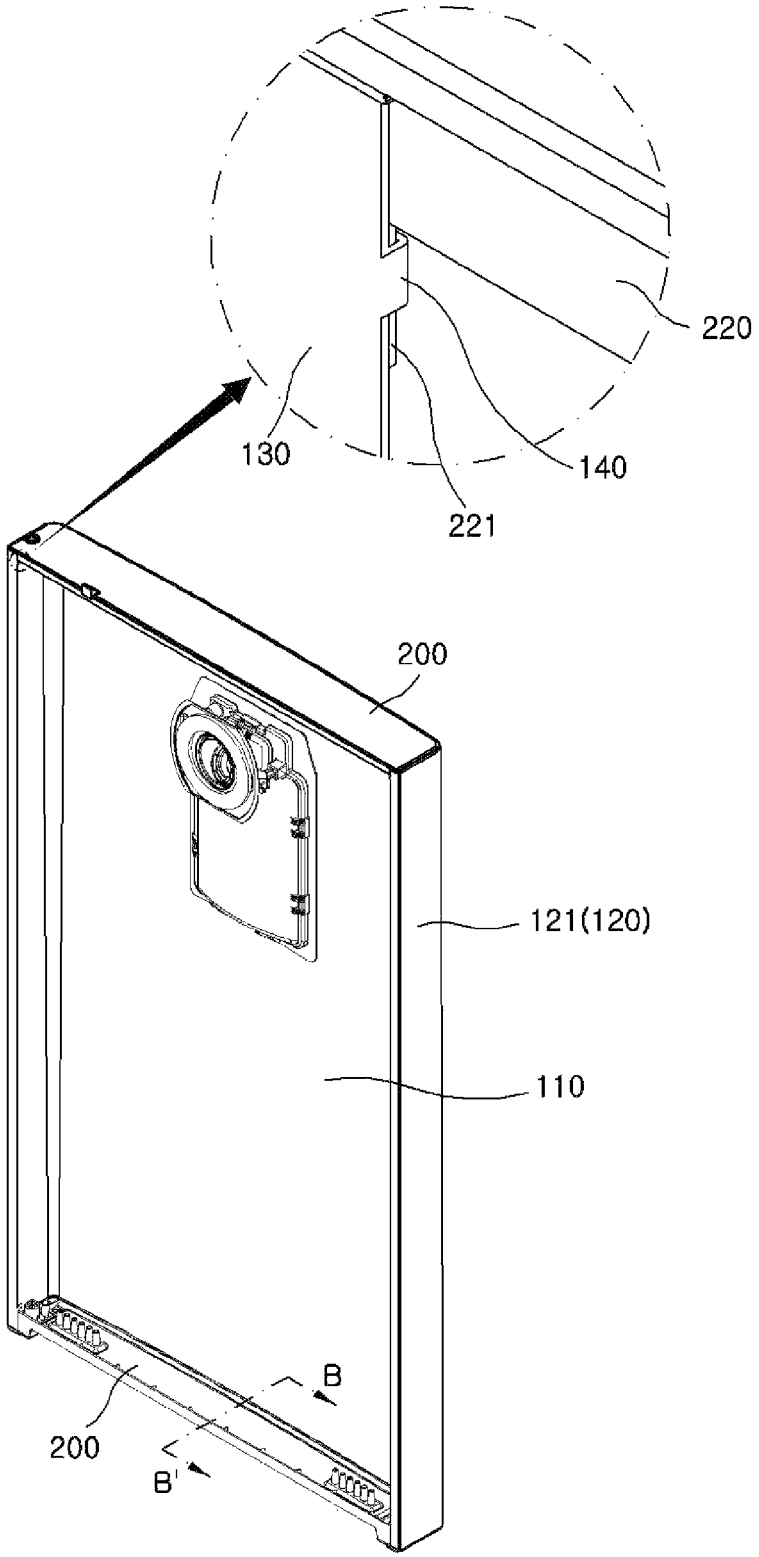
FIG. 5 is a rear perspective view of the door of the refrigerator illustrated in FIG. 1 according to one embodiment of the present disclosure.
Figure 6:
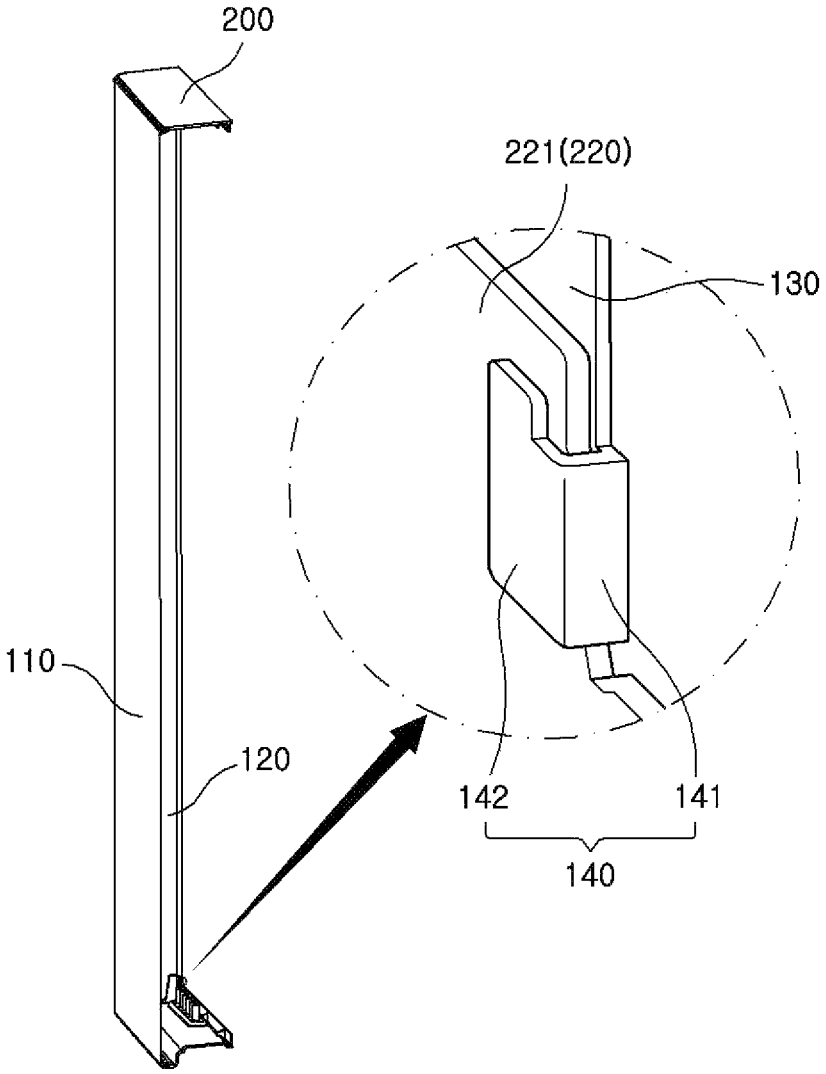
FIG. 6 is a sectional view of the door from the perspective of B-B' in FIG. 5 according to one embodiment of the present disclosure.
Figure 7:
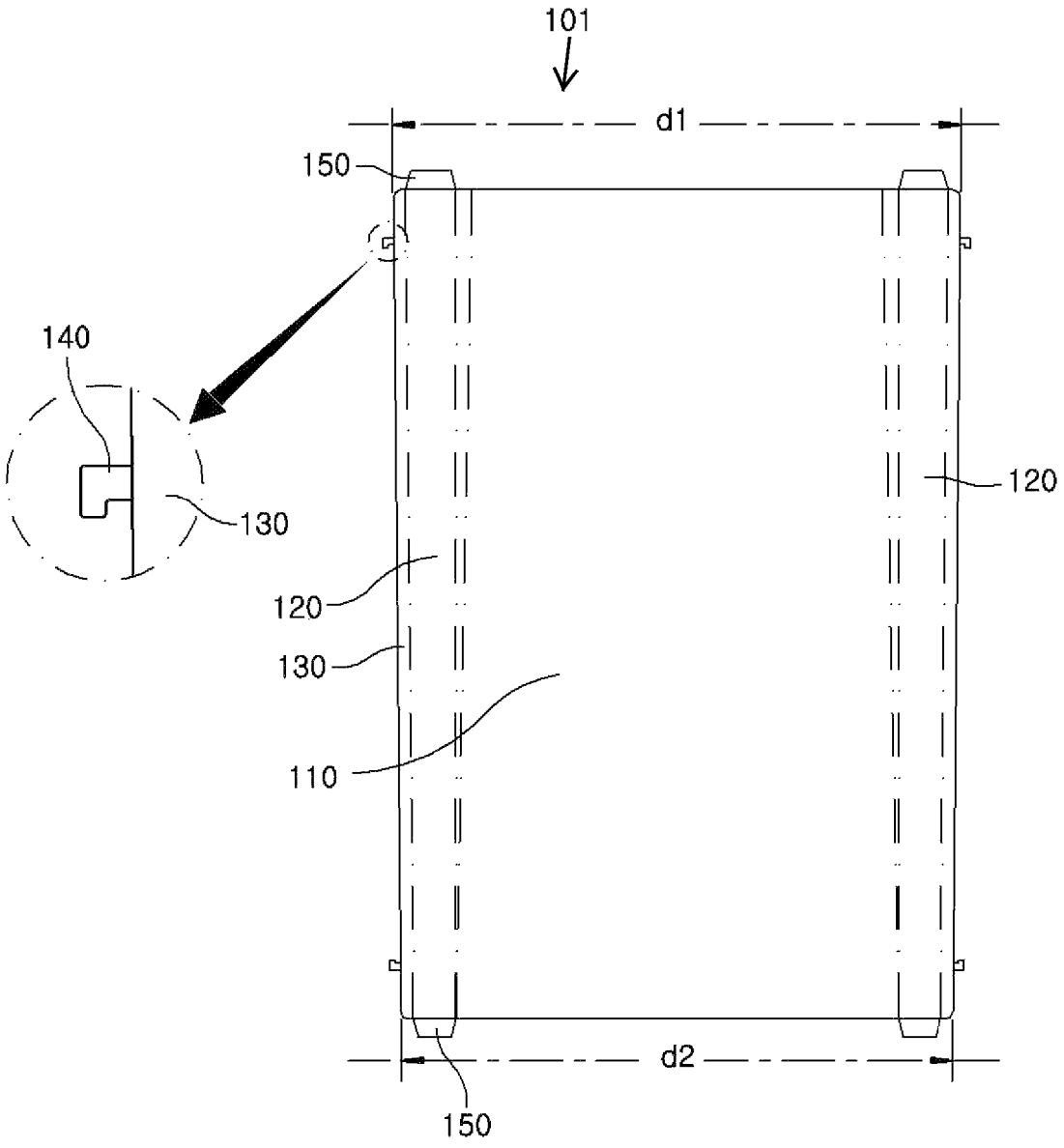
FIG. 7 illustrates an exemplary plate for the door of the refrigerator illustrated in FIG. 1 according to one embodiment of the present disclosure.

FIG. 1 is a perspective view illustrating a refrigerator including a heat dissipating blower according to one embodiment of the present disclosure. FIG. 2 is a perspective view of a door provided in the refrigerator illustrated in FIG. 1. FIG. 3 is an exploded perspective view of the door illustrated in FIG. 2. FIG. 4 is a sectional view of the door taken along line A-A' in FIG. 2. FIG. 5 is a rear perspective view of the door provided in the refrigerator illustrated in FIG. 1. FIG. 6 is a sectional perspective view of the door taken along line B-B' in FIG. 5. FIG. 7 illustrates a plate of the door provided in the refrigerator illustrated in FIG. 1.

Referring to FIGS. 1 to 7, the refrigerator 1 according to one embodiment of the present disclosure includes a refrigerator compartment 10 for storing food and a door 20 for selectively opening and closing the refrigerator compartment 10. The door 20 may be disposed on a front surface of the refrigerator 1.

The door 20 may have a rectangular cuboid shape and may include a front surface, a rear surface, a left surface, a right surface, an upper surface and a lower surface. The door 20 may include: a first frame 100 disposed on the front surface and the side surfaces; second frames 200 disposed in a direction different than the direction of first frame 100; a third frame 300 disposed on the rear side of the door 20 in a different direction than the first and second frames 200; and a foaming body (not shown) filled into a space between the first frame 100, the second frames 200 and the third frame 300.

The first frame 100 may be disposed on the front surface and the side surfaces. The first frame 100 may include: a front cover 110 configured to cover a front surface of the door 20; side portions 120 extending in a first direction and configured to cover side surfaces of the door 20; first frame rear portions 130 extending in a second direction; and an engagement portion 150 extending from the first frame rear portions 130.

The front cover 110 may be disposed on a front surface of the refrigerator 1 and cover the exterior of the door 20. The front cover 110 may have a flat or curved surface, for example.

The side portions 120 cover the side surfaces of the door 20 and extend from a top of door 20 to the ground surface. For example, the side portions 120 are connected to the front cover 110 and extend in a direction perpendicular to the ground surface. The side portions 120 may be formed from a plate and may be integrally formed with the front cover 110. The side portions 120 may extend from opposite lateral edges of the front cover 110. In other words, the side portions 120 may include a first side portion 121, and a second side portion 122 disposed at a side opposite from the first side portion 121. The first side portion 121 and the second side portion 122 may be integrally formed with the front cover 110. The first side portion 121 and the second side portion 122 may be formed by bending opposite lateral edges of a plate 101.

The portions connecting the side portions 120 and the front cover 110 may be formed of a curved surface having a predetermined radius of curvature. The radius of curvature may grow larger from a lower portion of the door 20 toward an upper portion thereof. For example, the radius of curvature R1 of the portions between the front cover 110 and the side portions 120 of the lower portion of the door 20 may be smaller than the radius of curvature R2 of the portions between the front cover 110 and the side portions 120 in the upper portion of the door 20. Even if the radii of curvature are different for the upper and lower portions of the door 20, the distance between the first side portion 121 and the second side portion 122 of the lower portion of the door 20 may be substantially equal to the distance between the first side portion 121 and the second side portion 122 of the upper portion of the door 20. When the first frame 100 is viewed from the front, the front surface of the first frame 100 may appear to have a rectangular shape.

The first frame rear portions 130 may extend from the rear edges of the side portions 120 in a direction substantially parallel to the front cover 110 of the first frame 100. In other words, the front cover 110 is provided at a front side of the side portions 120, and the first frame rear portions 130 may be provided at a rear side of the side portions 120. The first frame rear portions 130 may separate from the front cover 110. For example, the first frame rear portions 130 may be formed by bending the outer ends of the side portions 120 and may continuously extend from the side portions 120. Fixing portions 140 may be disposed on the first frame rear portions 130.

The fixing portions 140 may include plate-shaped or hook-shaped projections protruding from the first frame rear portions 130. The fixing portions 140 may include a body portion 141 and a head portion 142. The body portion 141 may include a projection protruding from each of the first frame rear portions 130 and extending in a direction perpendicular to the side surface of the door 20, and the projection may be folded into the first frame rear portions 130. The head portion 142 may be formed at an end of the body portion 141 and may extend up or down. For example, the body portion 141 may extend toward the center of the door in a direction perpendicular to the side surface of the door 20. The head portion 142 may extend in a direction perpendicular to a ground surface. If the fixing portions 140 are folded inside the first frame rear portions 130, the fixing portions 140 surround the extension portions 221 of a second frame rear portion 220. By folding the fixing portions 140, the extension portions 221 of the second frame rear portion 220 are inserted between the fixing portions 140 and the first frame rear portions 130, where the second frames 200 are fixed to the first frame 100.

The engagement portion 150 may be provided in at least one of one of the upper portion and the lower portion of the side portions 120. The engagement portion 150 may extend from the side portions 120 to the second frames 200. The engagement portion 150 may include a plate-shaped or tab-shaped projection. For example, the engagement portion 150 may extend from each of the side portions 120 parallel to the ground. The engagement portion 150 may be integrally formed with the front cover 110 and the side portions 120. For example, the engagement portion 150 may be formed by bending the upper portion or the lower portion of a plate, including the side portions 120, and may continuously extend from the side portions 120. The engagement portion 150 may be disposed within the accommodation portion 210 of the second frames 200.

The second frames 200 may be disposed on the upper surface or the lower surface of the door 20, and connect to an end portion (e.g., a top end or a bottom end) of the first frame 100. The second frames 200 extend in a different direction than the first frame 100. For example, when the front cover 110, the side portions 120 and the first frame rear portions 130 are perpendicular to the ground, the second frames 200 may extend in a direction parallel to the ground.

Each of the second frames 200 may include grooves 210 and a second frame rear portion 220.

The grooves 210 may be disposed at opposite ends of each of the second frames 200, and the engagement portions 150 of the first frame 100 may be inserted into the grooves 210. The grooves 210 may include slides or rails extending toward the front and rear sides of the door 20, and the engagement portions 150 may be coupled to the grooves 210 by sliding from the rear side of the door 20 toward the front side of the door 20 along the grooves 210. By engaging the engagement portions 150 with the grooves 210, when a foaming body is filled into an internal space between the first frame 100 and the second frames 200, the second frames 200 are prevented from being separated from the first frame 100, and the bond between the first frame 100 and the second frames 200 is preserved.

The second frame rear portion 220 may include a projection disposed in a direction parallel to the first frame rear portions 130. Extension portions 221 may be disposed at left and right ends of the second frame rear portion 220. The extension portions 221 may extend from the second frame rear portion 220 upward or downward in a direction perpendicular to the ground. For example, the extension portions 221 of the second frame rear portion 220 disposed at the lower side may include projections disposed at the left and right ends of the second frame rear portion 220 and extending upward from the second frame rear portion 220. The extension portions 221 are affixed to the fixing portions 140 and the first frame rear portions 130. In other words, the extension portions 221 disposed at opposite ends of the second frame rear portion 220 are inserted into the fixing portions 140 and the first frame rear portions 130 to fix the second frames 200 to the first frame 100. When a foaming body is inserted and the third frame 300 is fixed, the third frame 300 may press the foaming body. The second frames 200 are pulled towards the door 20, and the fixing portions 140 prevent the second frames 200 from being removed from the first frame 100.

According to one embodiment, the fixing portions 140 are disposed on the first frame 100, and the extension portions 221 are disposed on the second frames 200. Alternatively, the fixing portions 140 may be disposed on the second frames 200, and the extension portions 221 may be disposed on the first frame 100, for example.

A foaming body may be filled into an internal space between the door 20 between the first frame 100 and the second frames 200. The foaming body may include urethane, for example. The foaming body may serve as an insulation material and may also serve as an adhesive agent for bonding the first frame 100, the second frames 200 and the third frame 300 together. After filling the foaming body, the third frame 300 may be coupled to the first frame 100 and the second frames 200 at the rear side of the door 20.

The third frame 300 may be disposed on a rear surface of the door 20. The third frame 300 may extend to the side portions 120 of the first frame 100 and to the second frames 200. For example, the third frame 300 may be disposed in a direction perpendicular to the side portions 120 of the first frame 100 and the second frames 200. The third frame 300 may extend in a direction parallel to the front cover 110 of the first frame 100. According to some embodiments, the third frame 300 defines a space which accommodates racks for storing food within the refrigerator compartment 10.

Figure 8:
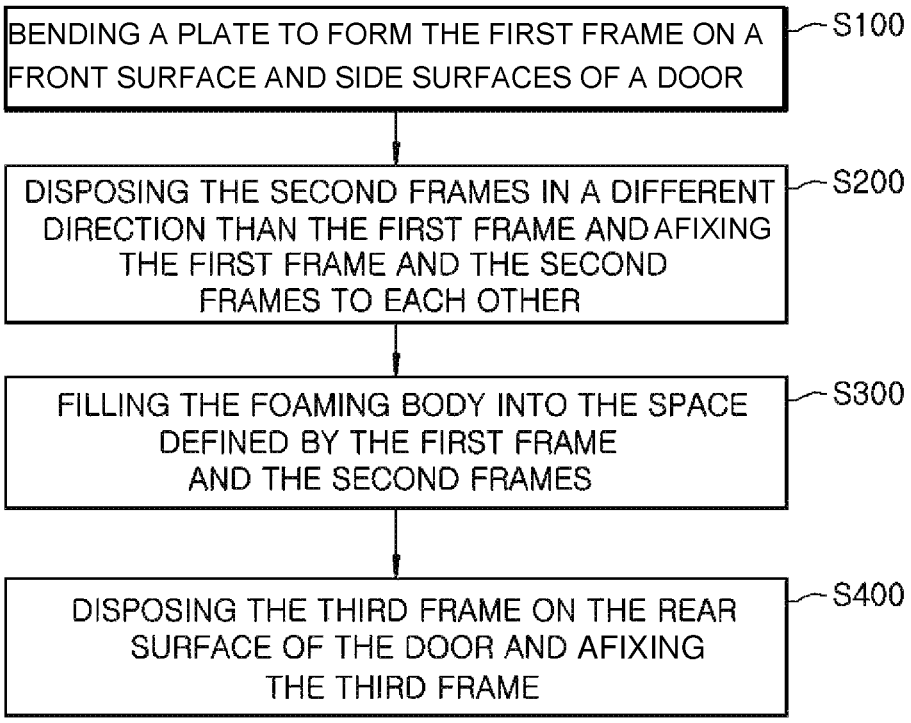
FIG. 8 is a flowchart illustrating an exemplary sequence of steps for performing a process of manufacturing a refrigerator according to one embodiment of the present disclosure.

Hereinafter, a method for manufacturing a refrigerator (e.g., refrigerator 10) will be described with reference to FIG. 8 according to embodiments of the present invention. FIG. 8 is a flowchart illustrating an exemplary sequence of steps of a process of manufacturing a refrigerator according to one embodiment of the present disclosure.

Referring to FIG. 8, a front surface and side surfaces of the door 20 are formed on the first frame 100 (S100). At this time, the front cover 110, the side portions 120 and the first frame rear portions 130 of the first frame 100 may be formed. The first frame 100 may be manufactured using a plate 101 having a relatively large width at an upper or a lower side thereof, and a relatively small width at another side thereof. For example, a portion of the plate 101 having a large width may be disposed at the upper side of the door 20, and a portion of the plate 101 having a small width may be disposed at the lower side of the door 20. The plate 101 have a trapezoidal shape. The fixing portions 140 may be disposed in advance at opposite lateral edges of the plate 101. The plate 101 used to form the first frame 100 may be manufactured by cutting a base plate in a trapezoidal shape such that the fixing portions 140 protrude from opposite lateral edges of the base plate. The plate 101 may be formed so that the plate 101 has a wide upper edge and a narrow lower edge. The base plate used to form the plate 101 may be a rectangular metal plate, for example. The front cover 110, the side portions 120, the first frame rear portions 130, the fixing portions 140 and the engagement portions 150 may be formed by bending or shaping plate 101. The front cover 110 and the side portions 120 may be bent to have a specific curvature, such as a curvature having a specific radius.

Opposite side portions of the plate 101 having the fixing portions 140 may be bent to form the side portions 120. The front cover 110 is disposed between the side portions 120. In this case, a radius of curvature R2 between the front cover 110 and the side portions 120 at the upper side of the door 20 may be larger than a radius of curvature R1 of the portions between the front cover 110 and the side portions 120, at a lower side of the door 20. The first frame rear portions 130 may be formed by bending an edge of the side portions 120. The engagement portions 150 may be formed by bending upper and lower edge portions of the side portions 120. According to some embodiments, the order of forming the side portions 120, the first frame rear portions 130 and the engagement portions 150 is modified.

The second frames 200 extend in a different direction than the first frame 100. For example, when the first frame 100 is perpendicular to the ground surface, the second frames 200 may be disposed at upper and lower sides of the first frame 100. The second frames 200 are fixed to the first frame 100 (S200). The first frame 100 and the second frames 200 may be coupled to each other while inserting the engagement portions 150 of the first frame 100 into the grooves 210 of the second frames 200. In this case, the engagement portions 150 may be inserted into the grooves 210. After first frame 100 and the second frames 200 are fixed to each other, the fixing portions 140 of the first frame 100 are bent to substantially surround the extension portions 221 of the second frame rear portion 220. At this time, the first frame 100 and the second frames 200 may be further coupled to each other by inserting the second frame rear portions 220 of the second frames 200 into the fixing portions 140 and the first frame rear portions 130.

A foaming body is filled into a space between the first frame 100 and the second frames 200 (S300). The third frame 300 is disposed on a rear surface of the door 20 and is coupled to the first frame 100 and/or the second frames 200 (S400). In this case, the first frame 100 and the second frames 200 are coupled to each other before filling the foaming body. This makes it possible to keep the first frame 100 and the second frames 200 fastened together when the foaming body is filled.

Although exemplary embodiments of the present disclosure are described above with reference to the accompanying drawings, those skilled in the art will understand that the present disclosure may be implemented in various ways without changing the necessary features or the spirit of the present disclosure.

Therefore, it should be understood that the exemplary embodiments described above are not limiting, but only an example in all respects. The scope of the present disclosure is expressed by claims below, not the detailed description, and it should be construed that all changes and modifications achieved from the meanings and scope of claims and equivalent concepts are included in the scope of the present disclosure.

From the foregoing, it will be appreciated that various embodiments of the present disclosure have been described herein for purposes of illustration, and that various modifications may be made without departing from the scope and spirit of the present disclosure. The exemplary embodiments disclosed in the specification of the present disclosure do not limit the present disclosure. The scope of the present disclosure will be interpreted by the claims below, and it will be construed that all techniques within the scope equivalent thereto belong to the scope of the present disclosure.

What is claimed is:

1. A refrigerator, comprising:

a refrigerator compartment; and a door configured to selectively open and close the refrigerator compartment, wherein the door comprises:

a first frame disposed on a front surface and side surfaces of the door; and second frames affixed to a top and a bottom of the first frame, wherein the first frame comprises a front portion configured to cover the front surface of the door, side portions configured to cover the side surfaces of the door, first frame rear portions connecting to the side portions, and fixing portions, wherein the second frames comprise second frame rear portions extending in a direction parallel to the first frame rear portions, wherein the fixing portions extend from the first frame rear portions and are folded to substantially surround the second frame rear portions and to affix the first frame to the second frames, and wherein the fixing portions comprise a body portion extending in a direction perpendicular to the side surfaces, and a head portion connected to the body portion.

2. The refrigerator of claim 1, wherein the door comprises a third frame disposed on a rear surface of the door, and wherein a foaming body is disposed in an internal space between the first frame, the second frames and the third frame.

3. The refrigerator of claim 1, wherein the first frame further comprises an engagement portion disposed on at least one of an upper and a lower portion of the door, and configured to extend to the second frames, wherein the second frames comprise an accommodation portion for receiving the engagement portion.

4. The refrigerator of claim 3, wherein the front portion and the side portions are formed to curve at a predetermined radius of curvature.

5. The refrigerator of claim 4, wherein a first radius of curvature between a lower portion of the front portion and a lower portion of each of the side portions is smaller than a second radius of curvature between an upper portion of the front portion and an upper portion of the side portions.

6. The refrigerator of claim 1, wherein the second frame rear portions are disposed between the fixing portions and the first frame rear portions, and wherein the second frame is fixed to the fixing portions and the first frame rear portions.

7. The refrigerator of claim 1, wherein the head portion extends in at least one of an upward direction and downward direction.

8. A refrigerator manufacturing method, the method comprising:

bending a plate to form a first frame disposed on a front surface and side surfaces of a door, wherein the door is operable to selectively open and close a refrigerator compartment;

connecting second frames to a top and a bottom of the first frame;

affixing the first frame to the second frames;

injecting a foaming body into a space between the first frame and the second frames;

disposing a third frame on a rear surface of the door; and affixing the third frame to at least one of the first frame and the second frames, wherein the first frame comprises a front portion configured to cover the front surface of the door, side portions configured to cover the side surfaces of the door, first frame rear portions connecting to the side portions, and fixing portions, wherein the second frames comprise second frame rear portions extending in a direction parallel to the first frame rear portions, wherein the fixing portions extend from the first frame rear portions and are folded to substantially surround the second frame rear portions and to affix the first frame to the second frames, and wherein the fixing portions comprise a body portion extending in a direction perpendicular to the side surfaces, and a head portion connected to the body portion.

9. The method of claim 8, wherein the second frames are disposed between the fixing portions and the first frame rear portions.

10. The method of claim 8, wherein the front portion, the side portions and the first frame rear portions of the first frame are integrally formed by bending a plate, and wherein the plate is formed wherein a first width of an upper portion of the plate for an upper side of the refrigerator compartment is larger than a second width of a lower portion of the plate for a lower side of the refrigerator compartment, wherein the fixing portions are disposed at opposite lateral edges of the plate.

11. The method of claim 8, wherein the first frame, the second frames and the third frame are affixed to one another by the foaming body.

12. The method of claim 10, wherein a base plate for forming the plate is manufactured by cutting the base plate in a trapezoidal shape such that the fixing portions protrude from opposite lateral edges of the plate.

* * * * *